United States Patent [19]

Yeager et al.

[11] 4,184,424

[45] Jan. 22, 1980

[54] WASTE MATERIAL TESTING APPARATUS

[75] Inventors: David M. Yeager, Toledo, Ohio; Hans T. Thumm, Temperance, Mich.

[73] Assignee: Browning-Ferris Industries of Ohio and Michigan, Inc., Toledo, Ohio

[21] Appl. No.: 900,345

[22] Filed: Apr. 27, 1978

[51] Int. Cl.[2] ..... B30B 1/32

[52] U.S. Cl. ..... 100/99; 73/825; 100/229 A

[58] Field of Search ..... 100/99, 229 A, 245; 99/341; 220/82 R, 82 A; 73/94, 825; 366/143

[56] References Cited

U.S. PATENT DOCUMENTS

| | | | |
|---|---|---|---|
| 2,224,248 | 12/1940 | Blum | 100/99 UX |
| 2,751,840 | 6/1956 | Layton | 99/341 X |
| 2,894,732 | 7/1959 | Taber | 366/143 |
| 3,347,341 | 10/1967 | Avrea | 220/82 R |
| 3,616,685 | 11/1971 | Strom | 73/94 |
| 3,787,830 | 1/1974 | Cato | 100/99 |

*Primary Examiner*—Billy J. Wilhite

*Attorney, Agent, or Firm*—Wilson, Fraser, Barker & Clemens

[57] ABSTRACT

A waste material testing apparatus which is portable, economically manufactured, suitable for a wide variety of waste materials, sturdy enough to withstand the required compacting pressures, and equipped with a means to enable the viewing of the interior of the attendant container section to observe the compacting efficiency of the apparatus.

2 Claims, 7 Drawing Figures

WASTE MATERIAL TESTING APPARATUS

BACKGROUND OF THE INVENTION

In an age of mushrooming technology and scientific innovation, it is ironic that one of man's oldest problems is becoming increasingly acute. The collection and disposal of modern waste products is a monumental task. Moreover, technological change has produced affluent throwaway societies in many of the industralized countries of the world. It is becoming apparant that one of the major impacts of technological development is a significant increase in the generation of solid wastes. Today in the United States, solid waste management is a national problem of considerable magnitude. The severity of the problem has caused a considerable amount of attention to be directed and focused on the improvement of solid waste management techniques. The United States Congress has passed legislation dealing with the problem under which research funds are available from the federal government for basic investigations of solid waste generation and management.

Typical waste disposal has been conventionally carried out according to one of three basic methods: sanitary landfill, incineration, or composting. Sanitary landfilling, permanently placing refuse under maximum density in the earth with daily ground cover, is the predominant method whenever sufficient land is available at low cost near the sources of waste generations.

The present invention is concerned with the handling of the waste material prior to its transportation to a landfill site. To most economically handle waste, it typically must be compacted or densified to reduce the volume of the attendant waste. Volume reduction, or densification of waste prior to landfilling, has been practiced in several different ways in this country up to the present time. First, waste or refuse has been compacted at the source in stationary compactors or in compactor vehicles. Such compaction significantly increases the efficiency of the collection procedure, yielding higher truck loads and lower transportation rates. Secondly, compaction of collected waste has been practiced at control locations, i.e. in transfer stations where collected waste is placed in high-energy compactors and compacted or pushed into special truck bodies which are then moved to the final deposition site. The high pressure stationary compactors being employed at the present time in transfer station operations achieve very high densities of the compacted waste. Stationary compactors can provide volume reductions from 2:1 to 20:1 depending upon the nature of the waste material. Compaction serves several purposes in addition to reducing the trips to a disposal area. Mixed refuse, for example, can be accommodated without difficulty. It is possible to mix corrugated boxes, for example, with cans, bottles, broken pallets, even partially filled liquid containers providing there is a sufficient quantity of paper to absorb the liquid.

Using a compactor also can reduce the labor required for refuse handling. In many operations, a cycle time of less than a minute, combined with pushbutton controls, permits one man operation. Fast handling means functions to militate against an accumulation of waste or trash in work areas.

Compactor usage may even improve the appearance of an industrial site. Space previously required for the storage of loose trash can be freed for other uses.

Compactor capacity typically depends upon the size and volume of the waste generated and the space available for the installation. Manifestly, the larger the storage container, the easier it is to load. Larger containers also have to be emptied and placed with less frequency. Selection of a particular size and shape depends primarily on the intended application. Such containers should typically be enclosed, fire resistant, sturdy enough for prolonged use, and compatible with the storage area and available haulage vehicles.

Rectangular containers are generally employed because they are more readily fabricated than cylindrical styles. Compacted material in containers, whether they be rectangular or cylindrical in shape, may, in certain instances, include voids since compaction is difficult to achieve unless sufficient compacting forces are applied. Of course, such voids are costly to the users as dumping fees and the resultant hauler's charges are based upon the capacity of the container whether it is filled to capacity or not.

SUMMARY OF THE INVENTION

With the above noted background in mind, it becomes apparent that in order to properly and economically deal with waste management, the nature of the waste being generated must be empirically examined in order to obtain maximum compaction and thereby most efficient utilization of the storage container. The present invention is directed to a system which can be utilized to test particular types of waste material and determine at the outset, the compaction characteristics of the generated waste to be handled under various compaction forces. Thereby, the size of the container and the energy requirements to fully load the same may be readily determined prior to the installation of a permanent ongoing system.

Accordingly, it is an object of the invention to produce a waste material testing apparatus which is readily portable, economically manufactured, suitable for a wide variety of waste materials, and sturdy enough to withstand the required compacting pressure.

Another object of the invention is to produce a waste material testing apparatus wherein the waste to be compacted may be physically viewed during compacting cycles to determine the energy requirements necessary to achieve the desired degree of compaction.

BRIEF DESCRIPTION OF THE DRAWINGS

The above, as well as other objects and advantages of the invention, will become readily apparent to one skilled in the art from reading the following detailed description of an embodiment of the invention when considered in the light of the accompanying drawings, in which.

DETAILED DESCRIPTION OF AN EMBODIMENT OF THE INVENTION

Figure 2:
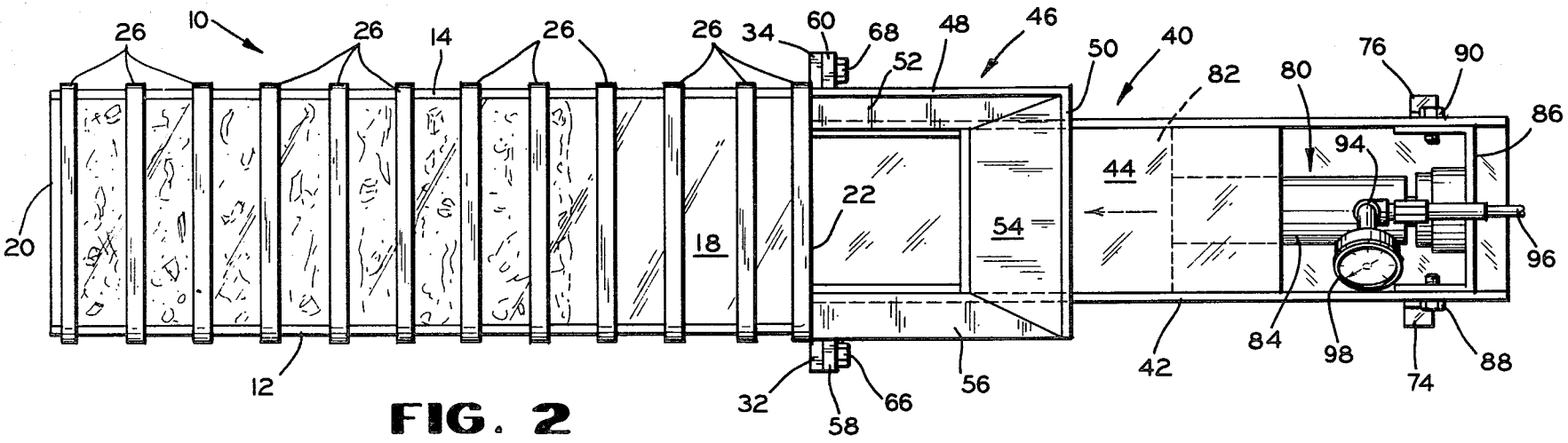
FIG. 2 is a top plan view of the apparatus illustrated in FIG. 1.

Referring to the drawings, there is shown a waste material testing apparatus including a container section generally designated by reference numeral 10 having spaced apart side walls 12 and 14, a bottom wall 16, a transparent top wall 18, and spaced apart end walls 20 and 22. The end wall 22 is provided with an aperture 24. With the exception of the top wall 18, the remainder of the container 10 is formed of a strong and sturdy metal plate material. A plurality of metal reinforcing bands 26 are caused to encircle the side walls 12, 14, and the top wall 18. The ends of the reinforcing bands 26 are welded or otherwise suitably secured to the marginal edge portions of the bottom wall 16.

The transparent top wall 18 is typically formed of a strong plastic material such as LEXAN, for example. LEXAN is a trademark for a commercially available optically transparent thermoplastic polycarbonate condensation product of bisphenol-A and phosgene.

To simulate an actual full size waste container, ground engaging wheel 28 and hauling truck body engaging rollers 30 may be attached to the undersurface of the bottom wall 16 of the container 10.

Generally adjacent the side edges of the aperture 24 in the end wall 22 are a pair of oppositely laterally extending bracket members 32 and 34. The bracket members 32 and 34 are provided with internally threaded holes 36 and 38, respectively, for receiving threaded fasteners as will be explained hereinafter.

A compactor section 40 is disposed adjacent to the container section 10 and includes an elongate channel 42 of generally U-shaped cross-section, an intermediate cover portion 44, and an open bottom hopper 46. The hopper 46 has two adjoining upstanding wall sections 48 and 50, and downwardly inclined sections 52, 54, and 56. A pair of oppositely laterally extending bracket members 58 and 60 are attached to opposite end edges of the channel 42. The bracket members 58 and 60 are provided with spaced apart apertures 62 and 64, respectively, which are adapted to align with the internally threaded apertures 36 and 38, respectively, of the bracket members 32 and 34. Threaded fasteners 66 are caused to extend through the apertures 62 in the bracket members 58 and into threaded engagement with the internally threaded holes 36 of the bracket members 34. Similarly, threaded fasteners 68 are caused to extend through the apertures 64 in the bracket members 60 and into threaded engagement with the internally threaded holes 38 of the bracket members 34. By tightening the threaded fasteners 66 and 68, the container section 10 and the compactor section 40 may be securely joined together. In the assembled form, the upstanding wall sections 48 and 50 and the downwardly inclined sections 52, 54, and 56 cooperate with the outer surface of the end wall 22 to produce the open bottom hopper 46.

The compactor section 40 is also provided with depending support brackets 74 and 76 which cooperate to effectively support the compactor section 40.

Figure 1:
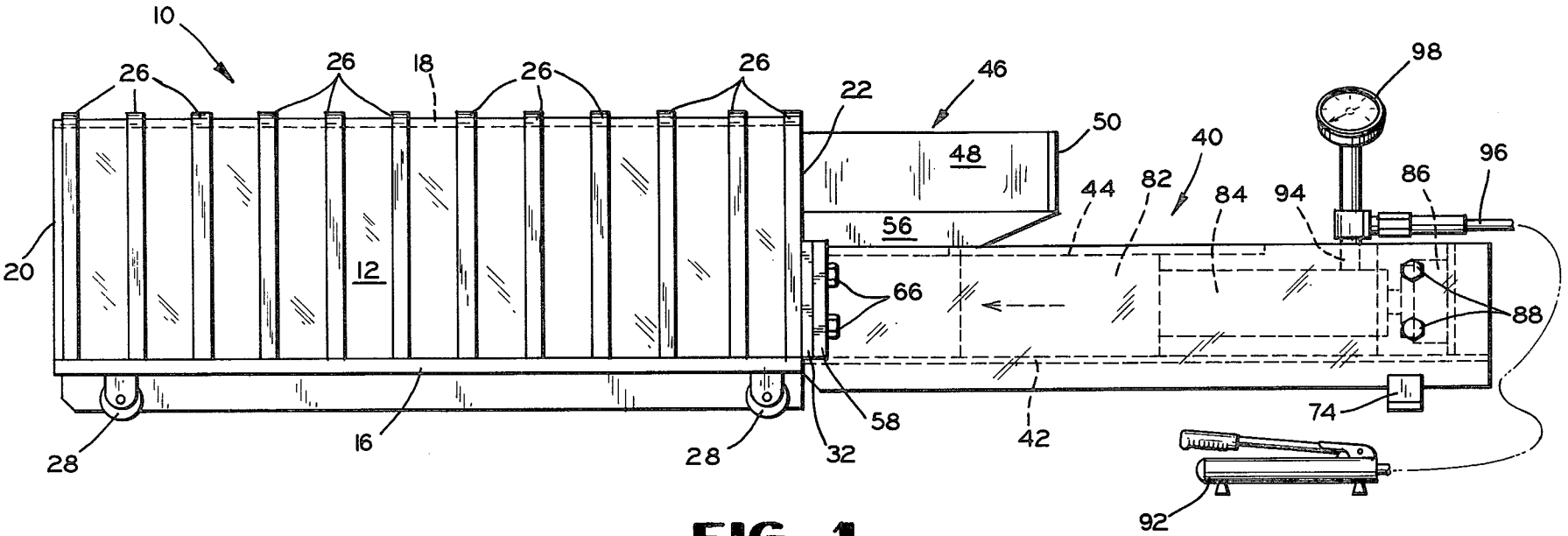
FIG. 1 is an elevational view of a waste material testing apparatus incorporating the salient features of the invention.
Figure 3:
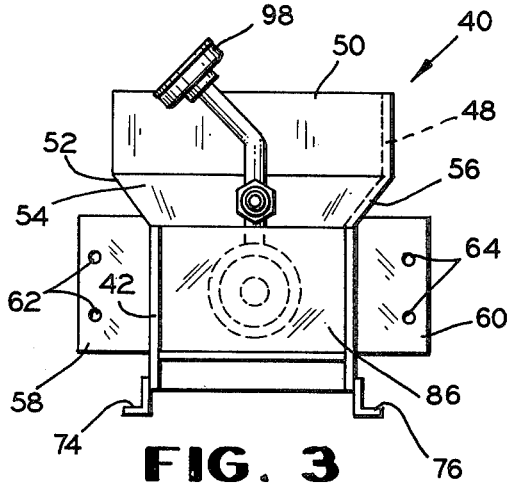
FIG. 3 is a right side view of the apparatus illustrated in FIGS. 1 and 2.
Figure 4:
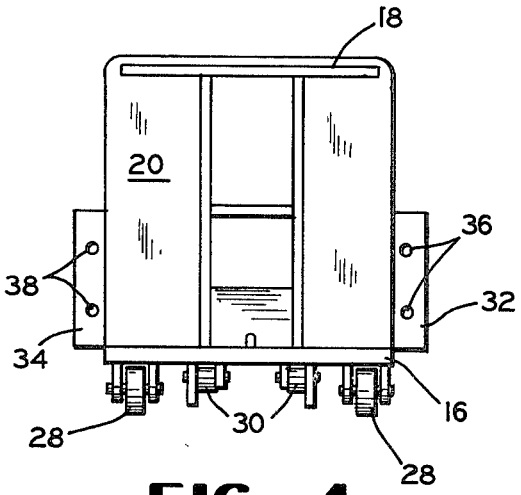
FIG. 4 is a left side view of the apparatus illustrated in FIGS. 1 and 2.
Figure 5:
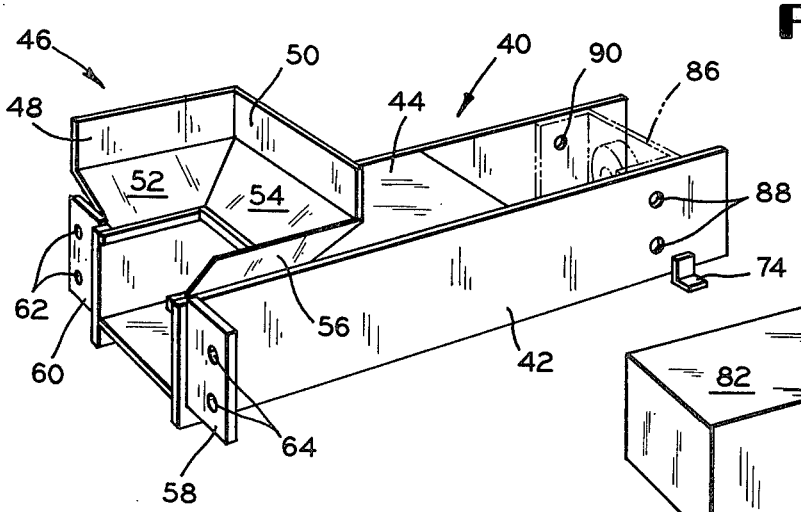
FIG. 5 is a perspective view of the compactor section of the apparatus illustrated in FIGS. 1 and 2.
Figure 6:
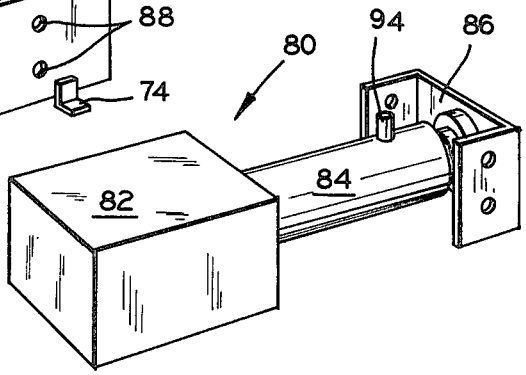
FIG. 6 is a perspective view of the ram section of the apparatus illustrated in FIGS. 1 and 2.
Figure 7:
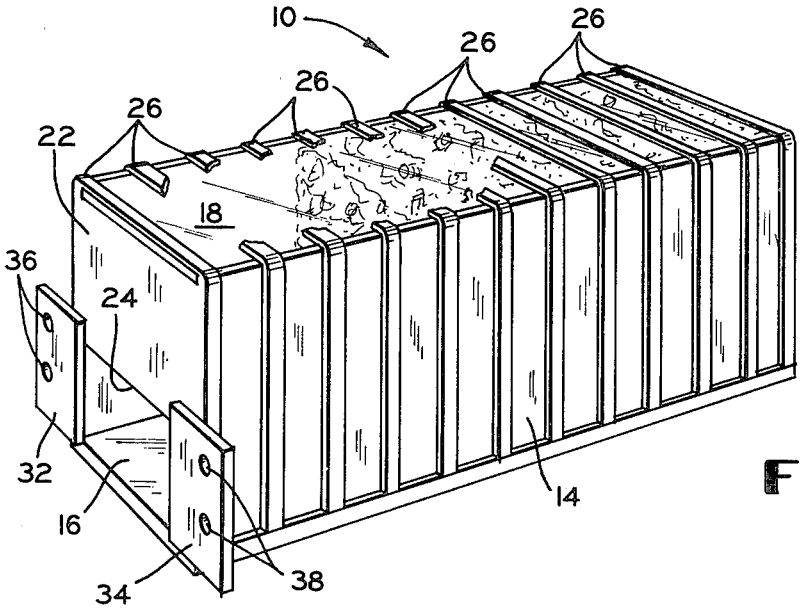
FIG. 7 is a perspective view of the container section of the apparatus illustrated in FIGS. 1 and 2 showing the container rotated approximately 180° from the position illustrated in FIGS. 1 and 2.

A ram section, generally indicated by reference numeral 80, is disposed within the interior of the U-shaped channel 42 of the compactor section 40. The ram section 80 includes a ram 82 which is generally rectangular in cross-section and is adapted to fit in sliding relation within the interior of the channel 42. A pressure fluid actuated extensible motor 84 has one end thereof suitably secured to the ram 82, while the opposite end is secured to a generally U-shaped bracket 86. The bracket 86 is secured to opposite side walls of the channel 42 by means of threaded fasteners 88 and 90, for example. The pressure fluid actuated extensible motor 84 typically includes a cylinder and an internally disposed axially movable piston of conventional design. Pressure fluid is introduced into the motor 84 from a source 92 to an inlet 94 through a suitable conduit 96. The source 92 of pressure fluid may be any of the conventional types such as, for example, a manually operated pneumatic pump. Manifestly, hydraulic systems could likewise be satisfactorily employed. In the illustrated embodiment of the invention, the motor 84 is provided with internal spring means (not shown) which effectively returns the ram 82 to the position illustrated in FIGS. 1 and 2 at the completion of each duty cycle.

Pressure indicating means 98 is attached to the inlet 94 to effectively monitor the pressure of the fluid being introduced into the system.

In operation, the apparatus discussed in the foregoing description is typically empolyed in waste management consideration. Since the overall length of the apparatus is approximately 44 inches, the width 8 inches, and the height 9½ inches, the apparatus is portable and is formed of materials having strength characteristics which are in scale to the strength of the materials used in full size waste handling systems. To assist in completely understanding the invention and its operation, let it be assumed that waste management engineers have the task of determining the proper sized compactor section and the energy requirements for suitably and effectively driving the ram of the compactor section for handling the compaction of broken wooden pallets. In such instance, scaled down wooden pallets are constructed and placed into the hopper 46. The material placed into the hopper 46 falls into the charging zone defined by the interior surfaces of the channel 42 immediately in advance of the face of the ram 82. The ram 82 is then caused to be moved in the direction of the arrows in FIGS. 1 and 2 by energization of the fluid motor 84. As the ram 82 moves in a direction toward the container section 10, the pallet sections which have dropped through the open bottom of the hopper 46 into the charging zone are caused to be moved into the container section 10 through the opening 24 in the end wall 22. At the conclusion of the driving stroke of the ram 82, the pressure of the fluid energizing the motor 80 is released allowing the ram 82 to return to the position illustrated in FIGS. 1 and 2. When the ram 82 is thereby withdrawn, the supply of broken pallets in the hopper 46 is allowed to drop into the zone in advance of the face of the ram 82 and the compacting cycle is repeated until the container section 10 is filled.

It will be apparent that as the scaled-down samples of the waste to be compacted are fed into the container section 10, the activity within the interior thereof may be viewed through the transparent upper wall 18. By being able to visually observe the compaction activity within the interior, the operator may empirically determine the amount of compaction force necessary to eliminate voids which may occur. Manifestly, since the pressure acting to drive the ram 82 may be viewed from observing the pressure indicating means 98, the proper amount of force may be readily translated from the apparatus of the invention to an actual full sized system.

The above invention has been found to be an extremely successful means of exhibiting to waste management engineers or even non-technical personnel, the necessary parameters for achieving the most efficient and economical full-sized apparatus to be used and therefor greatly assists in determining actual costs involved in waste compaction and the resultant haulage charges with the specific material to be hauled.

While the illustrated embodiment employs a transparent top wall section 18, it will be understood that, in certain instances, it may be desirable to form the side walls 12 and 14 of transparent material. In such an embodiment, the entire volume of material being compacted within the associated container may be viewed.

In accordance with the provisions of the Patent Statutes, we have explained the principle and mode of operation of our invention and have illustrated and described what we now consider to represent its best embodiment. However, it must be understood that within the spirit and the scope of the appended claims, the invention may be practiced otherwise than as specifically illustrated and described.

What we claim is:

1. An apparatus for testing the compressibility of waste materials varying in size, material content and density comprising, in combination, a portable six walled container simulating a commercial compactor container, one of said container walls having a charging aperture formed therein and another of said container walls having at least a portion of the wall formed of transparent materials, the transparent material extending from substantially adjacent the charging aperture to the wall opposed to said wall having the charging aperture formed therein;

a compactor unit including an open bottom hopper communicating with the top portions of a compression chamber, said compression chamber having one end connected to said aperture in the one wall of the container;

a ram unit reciprocal in said compression chamber to move waste material deposited in said hopper into the interior of said container;

fluid pressure means for advancing said ram unit towards said container, said fluid pressure means including a manually operable pressure generator; and means for indicating the pressure developed by said manually operable pressure generating means, whereby the compressibility characteristics of a selected lot of waste material may be determined by concurrently observing the degree of compaction of the waste material in said container and the maximum pressure required to establish the observed degree of compaction.

2. The testing apparatus defined in claim 1 wherein said side wall containing a transparent portion comprises a continuous sheet of transparent thermoplastic material.

* * * * *